US007751765B2

(12) United States Patent
Kurosu et al.

(10) Patent No.: US 7,751,765 B2
(45) Date of Patent: Jul. 6, 2010

(54) IMAGE FORMING APPARATUS WITH TRANSFERRING MEMBER TO TRANSFER TONER IMAGE ONTO THE RECORDING MEDIUM

(75) Inventors: Shigetaka Kurosu, Hino (JP); Satoshi Nishida, Saitama (JP); Kazuteru Ishizuka, Hachioji (JP)

(73) Assignee: Konica Minolta Business Technologies, Inc. (JP)

( * ) Notice: Subject to any disclaimer, the term of this patent is extended or adjusted under 35 U.S.C. 154(b) by 829 days.

(21) Appl. No.: 11/438,738

(22) Filed: May 22, 2006

(65) Prior Publication Data

US 2007/0025780 A1 Feb. 1, 2007

(30) Foreign Application Priority Data

Aug. 1, 2005 (JP) ..... 2005-222665

(51) Int. Cl.
*G03G 15/20* (2006.01)

(52) U.S. Cl. ..... 399/313; 399/324; 399/330; 399/331; 399/341; 399/384

(58) Field of Classification Search ..... 399/45, 399/313, 324, 330–331, 341, 384
See application file for complete search history.

(56) References Cited

U.S. PATENT DOCUMENTS

| | | | | |
|---|---|---|---|---|
| 5,140,348 | A * | 8/1992 | Jamzadeh et al. | 347/115 |
| 6,856,782 | B2 * | 2/2005 | Takahata et al. | 399/302 |
| 6,859,630 | B2 * | 2/2005 | Matsuda et al. | 399/66 |
| 6,879,798 | B2 * | 4/2005 | Aoki | 399/252 |
| 7,059,785 | B2 * | 6/2006 | Kato et al. | 400/62 |
| 7,536,125 | B2 * | 5/2009 | Yamamoto et al. | 399/45 |
| 7,634,210 | B2 * | 12/2009 | Soma et al. | 399/71 |

FOREIGN PATENT DOCUMENTS

| | | |
|---|---|---|
| JP | 5-158361 | 6/1993 |
| JP | 6-118805 | 4/1994 |
| JP | 08095963 A * | 4/1996 |
| JP | 2004-309696 | 11/2004 |
| JP | 2005-017570 | 1/2005 |

OTHER PUBLICATIONS

English translation of Nagai et al. (JP pub 08-095963), published Apr. 12, 1996.*
English translation of Mori (JP pub 2004-309696), published Nov. 4, 2004.*

* cited by examiner

*Primary Examiner*—David M Gray
*Assistant Examiner*—Geoffrey T Evans
(74) *Attorney, Agent, or Firm*—Cantor Colburn LLP

(57) ABSTRACT

There is described an image forming apparatus, which prevent toner from contaminating inside of the apparatus and the recording medium. The apparatus includes: an image bearing member; and a transferring member that press-contacts the image bearing member for transferring the toner image onto the recording medium. When the transferring member transfers the toner image onto the recording medium in such a state that the toner image is extended from an edge of the recording medium, the following relationship is fulfilled, $$0<A<B$$

where A: a length of an extended portion that the toner image residing on the image bearing member is extended from the edge of the recording medium; and B: a length of a distance from the edge of the recording medium to a position at which the transferring member and the image bearing member start to contact each other.

7 Claims, 6 Drawing Sheets

IMAGE FORMING APPARATUS WITH TRANSFERRING MEMBER TO TRANSFER TONER IMAGE ONTO THE RECORDING MEDIUM

This application is based on Japanese Patent Application NO. 2005-222665 filed on Aug. 1, 2005 in Japanese Patent Office, the entire content of which is hereby incorporated by reference.

BACKGROUND OF THE INVENTION

The present invention relates to an image forming apparatus, such as a copier, a printer, etc.

Conventionally, an image forming apparatus employing the electro-photographic method, such as a copier, a printer, etc., is provided with a photoreceptor member serving as a image bearing member, a charging device, a scanning unit, a developing roller, which are sequentially disposed around the photoreceptor member, and a transferring roller serving as a transferring member.

In the image forming apparatus mentioned in the above, a surface of the photoreceptor member is uniformly charged by the charging device, and then, an electrostatic latent image is formed on the charged surface of the photoreceptor member by scanning a laser beam modulated on the basis of the image data and emitted from the scanning unit onto it. Then, the developing roller develops electrostatic latent image with toner to form a toner-image on the surface of the photoreceptor member. Successively, the toner image formed on the surface of the photoreceptor member is transferred onto a paper sheet serving as a recording medium by employing the transferring roller. Through the abovementioned process, the image can be formed on the paper sheet.

Further, there has been well known a color image forming apparatus, or the like, which is provided with a plurality of developing rollers each of which corresponds to each of unicolor images (primary colors) and an intermediate transfer member, serving as another image bearing member, for overlapping the unicolor images respectively formed on the photoreceptor member with each other on it, so as to form a full color toner image by sequentially overlapping the unicolor images one by one with each other. Then, the color image forming apparatus forms a full color image on the paper sheet by transferring the full color toner image on to the paper sheet by employing the transferring roller serving as a transferring member.

Conventionally, such the image forming apparatus mentioned in the above has formed the image on the paper sheet with margin spaces located around a peripheral area of the paper sheet. However, recently, there has been getting proliferated in the market such a print-outputting method, called as a marginless print, that extends the image forming area up to at least one of the margin spaces.

For instance, there has been well known a document processing technology, called as an index print, for automatically adding index characters to the left edge portion (or the right edge portion). Further, in recent years, there has been getting also proliferated in the market such a printing method, called as a whole marginless print, that extends the image forming area up to at all of the margin spaces without having any margin space, when printing a pattern image, a photographic image, etc.

Incidentally, when a positional deviation, caused by the erroneous conveyance timing shift, etc., is generated between the toner image formed on the image bearing member and the paper sheet, the position of the image formed on the paper sheet is different from that of the original image read from the document. In almost cases, amounts of the erroneous conveyance timing shift are not constant, but differ from each other depending on the differences between sizes and kinds of the paper sheets or kinds of containers accommodating the paper sheets.

Accordingly, when conducting the marginless print, a positional deviation generated between the toner image and the paper sheet causes a defect of the image transferred onto the paper sheet, resulting in a formation of a very awkward image. In addition, the defect of the image is also caused by the size variation of the paper sheets.

To overcome the abovementioned drawbacks, considering the positional deviation caused by the erroneous conveyance timing shift and the size variation of the paper sheets, there has been conducted such an operation that a large-sized toner image, having a sufficient allowance, is formed on the image bearing member, so as to form a good image over the paper sheet without forming any defect, even if the erroneous conveyance timing shift of the paper sheet occurs.

When the marginless print is conducted over the edge portion of the paper sheet by employing the abovementioned operation, there has raised a problem that the surface of the transferring roller is contaminated by toner, and such the contaminated transferring roller causes the toner scattering inside the printer apparatus. Specifically, when the toner image, residing on the image bearing member and extended from the recording medium, directly contact the transferring roller, the toner is firmly absorbed and attached onto the transferring roller due to a combination of the contacting pressure of the transferring roller and the transferring electric field. It is quite difficult to clean the toner firmly absorbed and attached onto the transferring roller, and, especially for the high density image, even if the mechanical cleaning device, such as blade, etc., is employed for cleaning, sometimes, the reverse surface of the paper sheet would be contaminated, due to an occurrence of the toner passing-through phenomenon.

Further, when the polymerized toner, whose particle diameter is minimized and whose circularity is high, are employed in order to cope with the recent demands for high quality imaging, or when an amount of attached toner is relatively high as in the full-color image forming apparatus, it has tended to become more difficult than ever to secure the cleaning efficiency.

Still further, when the residual toner, which are not transferred onto the paper sheet, increase more than ever, there has raised a big problem that the toner scattering phenomenon causes the contamination inside the apparatus.

To solve the abovementioned problems, the several countermeasures have been proposed in this field.

For instance, to solve the problem of the contamination on the transferring roller when the index print operation is conducted at the edge portion of the paper sheet, Patent Document 1 sets forth a solution in which an interval between paper sheets is set at a value wider than that of a normal case, and the transferring process and the cleaning sequence are alternately conducted.

Further, Patent Document 2 sets forth a measure for preventing the contamination of the transferring roller and the contamination of the reverse surface of the paper sheet by conducting the transferring operation with a gap between the photoreceptor member and the transferring roller.

Still further, Patent Document 3 sets forth a method for making it possible to prevent an occurrence of the contamination so as to form a good full image by conducting the image forming operation in a state that a guiding paper sheet, which is larger than the paper sheet, is extended from the four edges of the paper sheet.

Yet further, Patent Document 4 sets forth a measure for cleaning the transferring roller by employing the cleaning blade.

[Patent Document 1]

Tokkai 2004-309696 (Japanese Non-Examined Patent Publication)

[Patent Document 2]

Tokkaihei 5-158361 (Japanese Non-Examined Patent Publication)

[Patent Document 3]

Tokkai 2005-17570 (Japanese Non-Examined Patent Publication)

[Patent Document 4]

Tokkaihei 6-118805 (Japanese Non-Examined Patent Publication)

However, the conventional technologies mentioned in the above still include various kinds of drawbacks to be solved.

According to the technology set forth in Patent Document 1, when forming a high density image so as to output it onto the recording medium, repetitions of plural cleaning operations should be necessary for achieving the sufficient cleaning effect, resulting in an extreme deterioration of the print productivity.

According to the technology set forth in Patent Document 2, it is impossible to sufficiently cope with the thickness changes between the recording mediums. Further, since a discharging phenomenon is liable to occur due to the loose contacting state between the photoreceptor member and the transferring roller, sometimes, it is impossible to obtain a good image. In addition, since the conveyance efficiency of the recording medium is lowered, the problem, such as the misalignment of transferred images, etc., is liable to occur.

According to the technology set forth in Patent Document 3, there have been arisen not only the problem of wasting the guide papers, but also various kinds of other problems in regard to the contacting property between the paper sheet and the guide paper. When those are close-contacted with each other by the electrostatic action, those would possibly shift or separate form each other in a mid course of the conveying operation.

According to the technology set forth in Patent Document 4, the cleaning mechanism has become complicated, and further, sometimes, a toner filming phenomenon has occurred on the transferring roller. Further, when the toner, such as the polymerized toner, etc., whose circularity is high, are employed, sometimes, a problem with respect to the cleaning efficiency has been arisen.

SUMMARY OF THE INVENTION

To overcome the abovementioned drawbacks in conventional image-recording apparatus, it is an object of the present invention to provide an image forming apparatus, in which a toner contamination on the transferring roller, which further causes another toner contamination on the reverse surface of the recording medium, and toner contaminations due to the toner scattering actions in the apparatus are prevented.

Accordingly, to overcome the cited shortcomings, the abovementioned object of the present invention can be attained by an image forming apparatus described as follow.

(1) An image forming apparatus, comprising: an image bearing member to bear a toner image; a recording medium that accepts the toner image to be transferred from the image bearing member; and a transferring member that press-contacts the image bearing member for transferring the toner image onto the recording medium; wherein, when the transferring member transfers the toner image residing on the image bearing member onto the recording medium in such a state that the toner image is extended from an edge of the recording medium, a following relationship is fulfilled, $$0<A<B$$

where

A: a length of an extended portion that the toner image residing on the image bearing member is extended from the edge of the recording medium;

B: a length of a distance from the edge of the recording medium to a position at which the transferring member and the image bearing member start to contact each other outside the edge of the recording medium; and wherein directions that regulate A and B are the same as each other.

BRIEF DESCRIPTION OF THE DRAWINGS

Embodiments will now be described, by way of example only, with reference to the accompanying drawings which are meant to be exemplary, not limiting, and wherein like elements are numbered alike in several Figures, in which.

DETAILED DESCRIPTION OF THE PREFERRED EMBODIMENT

Figure 1:
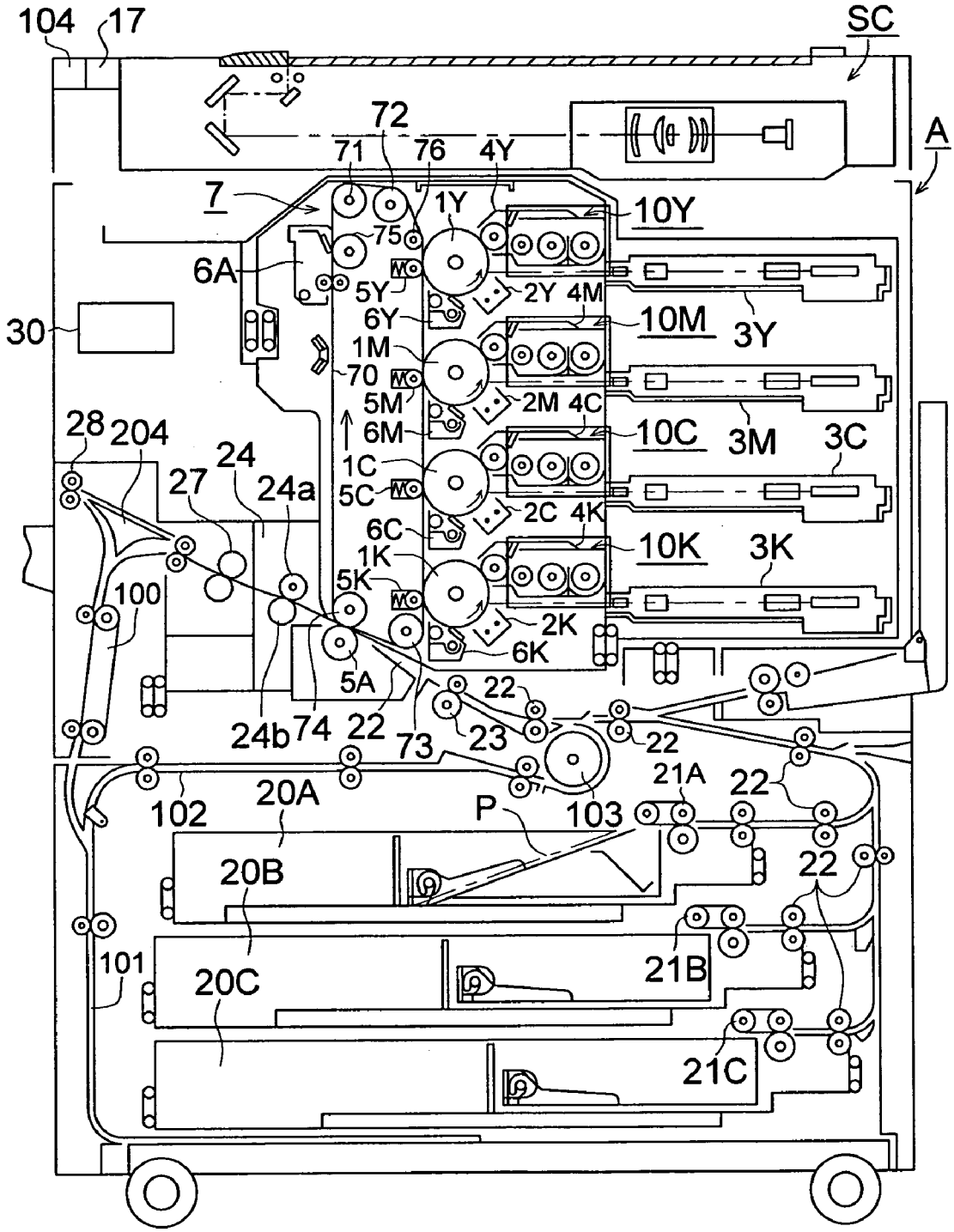
FIG. 1 shows an overall configuration of a color image forming apparatus, serving as an example of an image forming apparatus embodied in the present invention.

Referring to FIG. 1, an image forming apparatus embodied in the present invention will be detailed in the following.

The image forming apparatus shown in FIG. 1 is a color image forming apparatus provided with four sets of image forming sections. Concretely speaking, the color image forming apparatus is provided with image forming sections 10Y, 10M, 10C, 10K, an intermediate transfer unit 7 having an endless belt-type intermediate transfer member, a paper conveyance and fixing section 24, a controlling section 30 for totally controlling the operations of the apparatus as a whole, an operation inputting section 104, a displaying section 17, etc. Further, an original document reading device SC is disposed at the upper side of a main body AA of the color image forming apparatus.

The image forming section 10Y for forming a toner image of color Y (Yellow) includes a photoreceptor drum 1Y serving as an image forming element, and further includes a charging device 2Y, an exposing device 3Y, a developing device 4Y, a primary transferring roller 5Y serving as a primary transferring device and a cleaning device 6Y, all of which are disposed at respective positions in the peripheral space around the circumferential surface of the photoreceptor drum 1Y. Further, the image forming section 10M for forming a toner image of color M (Magenta) includes a photoreceptor drum 1M serving as an image forming element, and further includes a charging device 2M, an exposing device 3M, a developing device 4M, a primary transferring roller 5M serving as a primary transferring device and a cleaning device 6M, all of which are disposed at respective positions in the peripheral space around the circumferential surface of the photoreceptor drum 1M. Still further, the image forming section 10C for forming a toner image of color C (Cyan) includes a photoreceptor drum 1C serving as an image forming element, and further includes a charging device 2C, an exposing device 3C, a developing device 4C, a primary transferring roller 5C serving as a primary transferring device and a cleaning device 6C, all of which are disposed at respective positions in the peripheral space around the circumferential surface of the photoreceptor drum 1C. Yet further, the image forming section 10K for forming a toner image of color K (Black) includes a photoreceptor drum 1K serving as an image forming element, and further includes a charging device 2K, an exposing device 3K, a developing device 4K, a primary transferring roller 5K serving as a primary transferring device and a cleaning device 6K, all of which are disposed at respective positions in the peripheral space around the circumferential surface of the photoreceptor drum 1Y.

An OPC photoreceptor member, an aSi (amorphous Silicon) photoreceptor member, etc., which are made of organic semiconductor material, are preferably employed for the photoreceptor drums 1Y, 1M, 1C, 1K. A scotron charging device having a control grid is preferably employed for the charging devices 2Y, 2M, 2C, 2K. A scanning exposure device having a laser light source or a scanning exposure device having a LED (Light Emitting Diode) light source, etc., is preferably employed as each of the exposing devices 3Y, 3M, 3C, 3K. In the embodiment shown in FIG. 5, each of the exposing devices 3Y, 3M, 3C, 3K has a laser light source.

Either one component developer or two components developer can be employed in the developing devices 4Y, 4M, 4C, 4K. The reversal developing method, for attaching toner, charged at a polarity same as that of an electrostatic latent image, to the exposed area of the circumferential surface of the photoreceptor drum, is preferably employed for the developing device. As will be described later, each of the developing devices 4Y, 4M, 4C, 4K conducts a developing operation while applying a developing bias voltage in which DC bias voltage and AC bias voltage are overlapped with each other.

A transferring device having either a transferring roller or a corona discharger is employed as each of the primary transferring devices 5Y, 5M, 5C, 5K. The transferring device, having the transferring roller, also has a transferring power source for applying the transferring current to the transferring roller.

The intermediate transfer unit 7 includes a plurality of rollers 71-76 and an intermediate transfer member 70 shaped in an endless semiconductor belt, which is threaded on the plurality of rollers 71-76 so as to circulate around them (an example of the image bearing member).

In image forming section 10Y, according with the anti-clockwise rotating action of the photoreceptor drum 1Y as indicated by the arrow shown in FIG. 1, the toner image of color Y is formed on the photoreceptor drum 1Y through the process including the charging operation conducted by the charging device 2Y, the exposing operation conducted by the exposing device 3Y and the developing operation conducted by the developing device 4Y. Further, the toner image formed on the photoreceptor drum 1Y is transferred onto the intermediate transfer member 70 by activating the primary transferring roller 5Y.

Through the process same as that performed in image forming section 10Y, the toner images of color M, color C and color K, are also formed on the photoreceptor drums 1M, 1C, 1K in the image forming sections 10M, 10C, 10K, respectively, and then, are sequentially transferred onto the intermediate transfer member 70 in such a manner that the toner images of color Y, color M, color C and color K overlap with each other. As a result, a full color toner image is formed on the intermediate transfer member 70. Then, the full color toner image formed on the intermediate transfer member 70 is transferred onto a recording medium P by pressing a secondary transferring roller 5A against the recording medium P so that the recording medium P press-contacts the full color toner image. Successively, the full color toner image is fixed onto the recording medium P in the paper conveyance and fixing section 24, and then, the recording medium P having the fixed toner image is ejected to an outside of the apparatus by activating an ejecting roller 28.

It is applicable that the rotating action of the secondary transferring roller 5A is driven by the circulating action of the intermediate transfer member 70 or the roller 74, or independently driven in a direction same as the circulating direction of the intermediate transfer member 70 at the contacting point.

Figure 4:
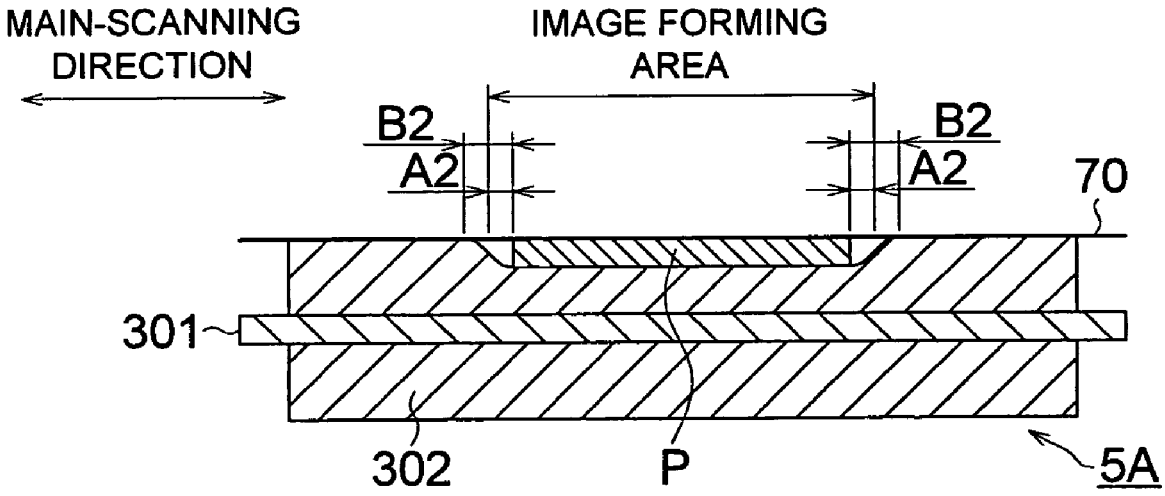
FIG. 4 shows a cross sectional view of a secondary transferring roller and a recording medium in a main-scanning direction, indicating a state of secondary transferring operation in a marginless print mode of the image forming apparatus shown in FIG. 1.

As shown in FIG. 4, the secondary transferring roller 5A employed in the present embodiment is so constituted that an elastic layer 302 is formed on the whole circumferential surface of a core metal 301 shaped in a cylindrical form.

Various kinds of materials, such as an EPDM, an urethane, a NBR, a silicon rubber, a rubber material in which conductive materials, such as carbon black, a metal oxide, etc., are mingled with the IR, etc. for adjusting its resistivity, a foam material made of one of the abovementioned materials, etc., can be cited as an elastic material to be employed for the elastic layer 302. The secondary transferring roller 5A is mounted in such a manner that the secondary transferring roller 5A press-contacts the recording medium P with a predetermined pressure so as to oppose against the elasticity of the elastic layer at the time of the secondary transferring operation. In the present embodiment, a transferring nip section having a width of several millimeters is formed on the secondary transferring roller 5A.

Figure 2:
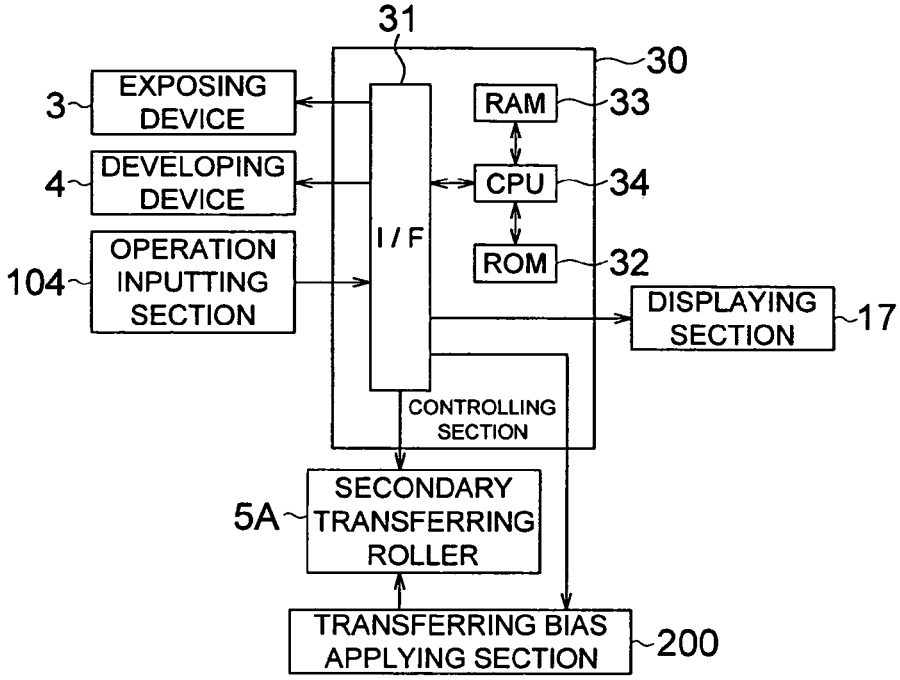
FIG. 2 shows a block diagram of a controlling system for conducting controlling operations in a marginless print mode of the image forming apparatus shown in FIG. 1.

Further, at the time of the secondary transferring operation, the transferring bias is applied to the secondary transferring roller 5A from a transferring bias applying section 200 (shown in FIG. 2). In the present embodiment, the transferring current is applied as the transferring bias.

Each length of the intermediate transfer member 70 and secondary transferring roller 5A in a direction substantially orthogonal to the conveyance direction of the recording medium P (namely, a width direction of the recording medium P) is set at such a value that each length is longer than that of a recording medium having a maximum size allowable (usable) for the image forming apparatus.

A heat roller fixing unit having a heating roller 24*a* and a pressing roller 24*b* is employed as the paper conveyance and fixing section 24.

In the duplex image forming operation, the recording medium P, on the obverse surface of which the image is already formed and fixed, is guided and conveyed into a conveyance path 100 by a guiding member 204 after passing through a fixing eject roller 27. Then, after the switch backing operation performed in a switch backing path 101, the recording medium P is again introduced into the secondary transferring roller 5A from a paper re-feeding path 102 through a conveyance roller 103 so as to conduct a reverse image forming operation by transferring a toner image onto the reverse surface of the recording medium P by activating the secondary transferring roller 5A.

Through the same process as aforementioned, the color toner image to be formed on the reverse surface of the recording medium P is formed on the intermediate transfer member 70, and then, transferred onto the reverse surface of the recording medium P from the intermediate transfer member 70.

The recording medium P, which is accommodated in any one of paper feeding trays 20A, 20B, 20C, is conveyed out by any one of paper feeding sections 21A, 21B, 21C, and then, conveyed to a registration roller 23 by an intermediate conveyance roller 22. The registration roller 23, which is an example of a conveyance section for conveying the recording medium to the transferring position at which the intermediate transfer member bearing the toner image is opposed against the secondary transferring roller, is activated so as to be synchronized with the actions of the image forming sections 10Y, 10M, 10C, 10K and the intermediate transfer member 70, in order to feed the recording medium P to the transferring position at which the intermediate transfer member 70 bearing the toner image is opposed against the secondary transferring roller 5A. The recording mediums whose sizes are different from each other are respectively accommodated in the paper feeding trays 20A, 20B, 20C. Based on the command signal inputted from the operation inputting section 104, the recording medium having a specific size is fed from corresponding one of the paper feeding trays 20A, 20B, 20C.

After the toner image transferring operation is completed, the intermediate transfer member 70 is cleaned by a cleaning device 6A.

Further, the color image forming apparatus is provided with a selector switch (not shown in the drawings) for switching a printing mode to the marginless print mode in which the image forming area is extended up to at least one of the margin spaces located at the peripheral edge area of the recording medium. The color image forming apparatus is so constituted that the marginless print is conducted when the marginless print mode is selected by switching the selector switch.

FIG. 2 shows a block diagram of a controlling system for conducting such the marginless print mode. The configurations of the exposing devices 3Y, 3M, 3C, 3K are common to each other and the configurations of the developing devices 4Y, 3M, 3C, 3K are also common to each other, and are respectively indicated by numerals 3, 4 in FIG. 2.

As shown in FIG. 2, the controlling section 30 is constituted by an I/F (Interface) section 31, a ROM (Read Only Memory) 32, a RAM (Random Access Memory) 33, a CPU (Central Processing Unit) 34, etc., in order to control various kinds of devices coupled to the I/F section 31, based on the controlling programs and the controlling data stored in the ROM 32.

The displaying section 17 for displaying errors and a status of each of the sections, etc., the exposing device 3, the developing device 4, the secondary transferring roller 5A, a transfer bias applying section 200, the operation inputting section 104 for inputting the marginless print mode and setting the size of the recording medium P, etc., are electrically coupled to the I/F section 31.

The data of the image forming area on the photoreceptor drum in the marginless print mode, transferring current values to be applied to the secondary transferring roller 5A, etc., are stored in the ROM 32.

A plurality of data sets can be stored in the RAM 33, only during the time when the electric power is fed to the RAM 33. A storage area in which various kinds of data, such as image data for conducting the image forming operation for forming the image on the recording medium P, etc., a working area to be used by the CPU 34, etc., are provided in the RAM 33.

The CPU 34 develops a program designated from the various kinds of programs stored in the ROM 32 into the working area provided in the RAM 33, so as to conduct various kinds of operations based on the program in response to the inputted signals sent from each inputting section.

Incidentally, the image forming area on the photoreceptor drum includes a first area that extends in a main-scanning direction and a second area that extends in a sub-scanning direction. After the exposing device conducts the exposing operation based on the image data corresponding to either the first area or the second area so as to form the electrostatic latent image, the toner image is formed by developing the electrostatic latent image. The main-scanning direction is substantially the same as the axial direction of the photoreceptor drum 1, and also, substantially the same as the width direction of the recording medium. Further, in the secondary transferring operation, the main-scanning direction is substantially the same as the axial direction of the secondary transferring roller. While, the sub-scanning direction is substantially the same as the rotating direction of the photoreceptor drum 1, and, in the secondary transferring operation, substantially the same as the conveyance direction of the recording medium. In the marginless print mode, this image forming area differs from that in the normal print mode with edge margins. In addition, this image forming area also varies depending on the size of the recording medium.

Referring to the case in which the marginless print operation is applied to all of four edge portions located at peripheral edge area of the recording medium, the image forming area and the secondary transferring operation will be detailed in the following.

In response to the instruction for commencing the image forming operation after the marginless print mode and the size of the recording medium are set, the controlling section 30 reads out the data of the image forming area from the ROM 32, and then, activates the exposing device 3 so as to form the electrostatic latent image on the photoreceptor drum 1 within such the image forming area that is extended from the four edge portions of the recording medium P, based on the read-out data.

Accordingly, when the controlling section 30 conducts the marginless print mode, the exposing device 3 forms the electrostatic latent image extending over the four edge portions of the recording medium P. Successively, the developing device 4 develops the electrostatic latent image, and then, the full color toner image, formed by overlapping the electrostatic latent images with each other on the intermediate transfer member 70, is secondary transferred onto the recording medium P, conveyed to the transferring position, in such a manner that the full color toner image extends out from the four edge portions of the recording medium P. As a result, the marginless print having no margin spaces at the edge portions located at the peripheral edge area of the recording medium P can be achieved. Further, at the time of the secondary transferring operation, the controlling section 30 controls the transferring bias applying section 200 so as to apply the transferring bias current to the secondary transferring roller 5A.

Figure 3:
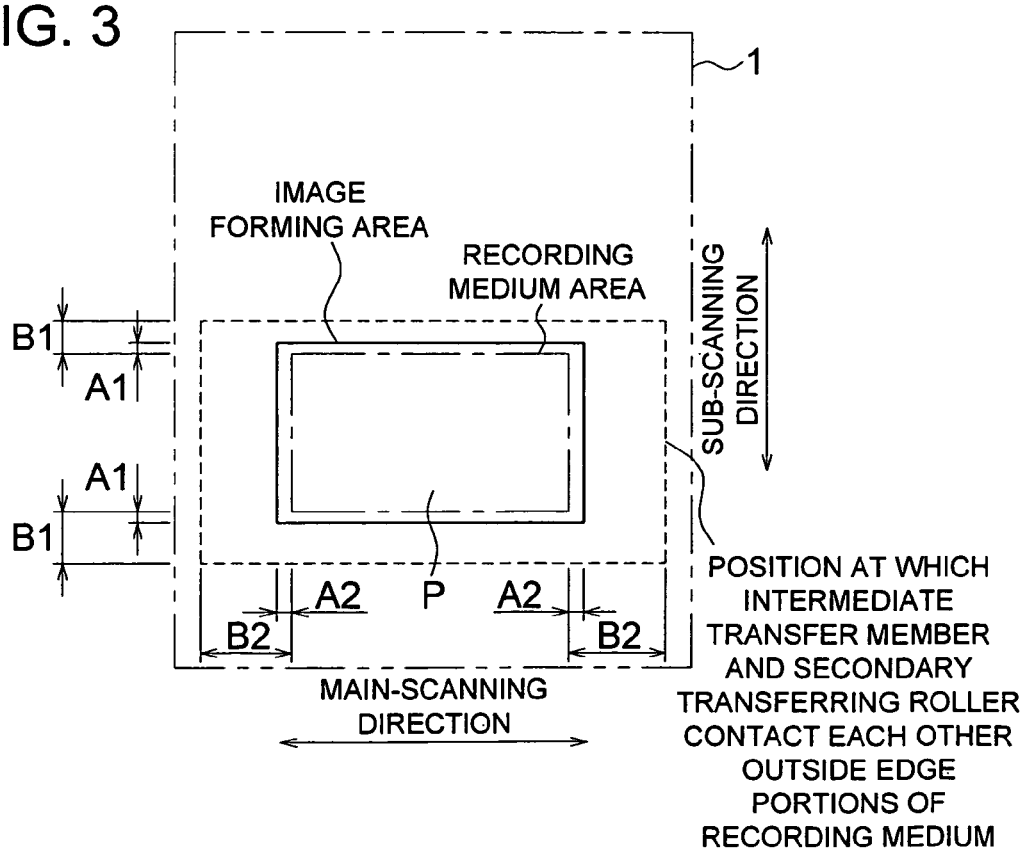
FIG. 3 shows an image forming area on a photoreceptor drum in a marginless print mode of the image forming apparatus shown in FIG. 1.

FIG. 3 shows the image forming area on the photoreceptor drum 1 in the marginless print mode. In FIG. 3, the circumferential surface of the photoreceptor drum 1 is depicted as a plane surface. Further, in FIG. 3, alternate long and two short dashes lines indicate the photoreceptor drum 1, solid lines indicate the four edges of the image forming area, alternate long and short dash lines indicate the four edges of the recording medium P (or the position of the recording medium P) at the time of the secondary transferring operation, and broken lines indicate the outside area from four edges of the recording medium P, where the secondary transferring roller 5A press-contacts the intermediate transfer member 70.

FIG. 4 shows a cross sectional view of the secondary transferring roller 5A and the recording medium P in the main-scanning direction, indicating a state of secondary transferring operation after the toner image, formed within the image forming area on the photoreceptor drum as shown in FIG. 3, is primarily transferred onto the intermediate transfer member.

Figure 5:
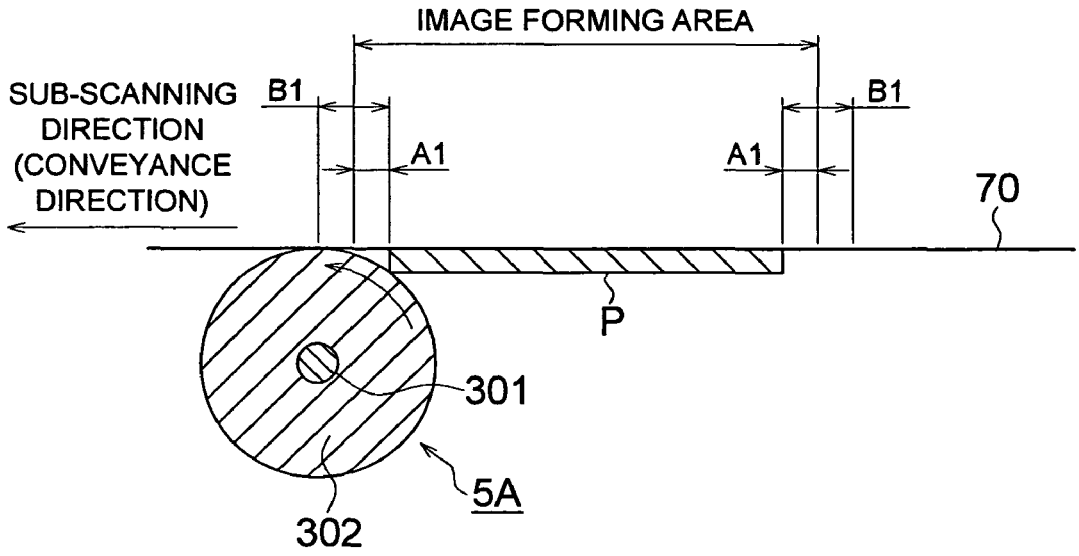
FIG. 5(*a*) and FIG. 5(*b*) show cross sectional views of a secondary transferring roller and a recording medium in a sub-scanning direction, FIG. 5(*a*) indicating a state at the time of commencing a transferring operation, and FIG. 5(*b*) indicating a state at the time of completing the transferring operation.
Figure 5:
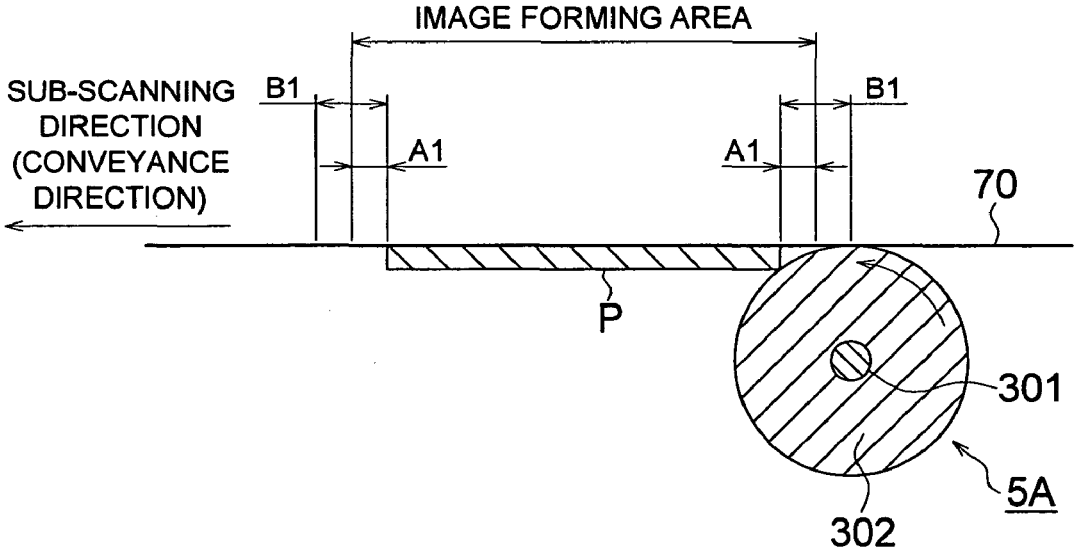

Further, FIG. 5(*a*) and FIG. 5(*b*) show cross sectional views of the secondary transferring roller 5A and the recording medium P in the sub-scanning direction. FIG. 5(*a*) indicates a state at the time of commencing the transferring operation, while FIG. 5(*b*) indicates a state at the time of completing the transferring operation. Further, during the transferring operation, the secondary transferring roller 5A rotates in a direction indicated by the arrow shown in FIG. 5(*a*) and FIG. 5(*b*).

Figure 6:
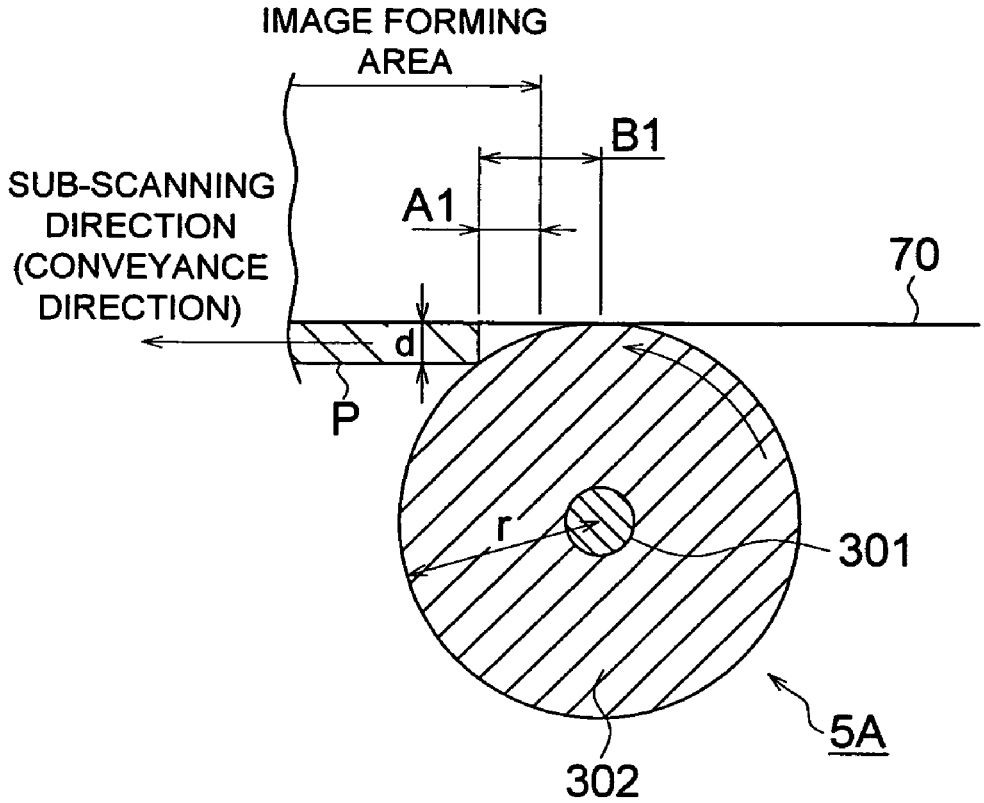
FIG. 6 shows an enlarged cross sectional view of FIG. 5(*b*)

Still further, FIG. 6 shows an enlarged cross sectional view of FIG. 5(*b*).

Incidentally, in FIGS. 4 through 6, the roller 74, shown in FIG. 1, is omitted.

As indicated in the above, when conducting the marginless print for forming an image all over the four edges of the recording medium P, the positions of four edges of the image forming area are set at such positions that are located outside the four edges of the recording medium P and do not exceed four positions at each of which the secondary transferring roller 5A and the intermediate transfer member 70 contact each other outside each of the four edges of the recording medium P.

& Concretely speaking, the image forming area is established so as to fulfill the relationships shown as follow.

$$0<A1<B1$$

$$0<A2<B2$$

where,

A1: length of a portion of the image forming area, which is extended from the edge of the recording medium P in the sub-scanning direction, B1: length of a distance from an edge of the recording medium P to a position at which the secondary transferring roller 5A and the intermediate transfer member 70 start to contact each other outside the edge of the recording medium P in the sub-scanning direction, A2: length of a portion of the image forming area, which is extended from the edge of the recording medium P in the main-scanning direction, B2: length of a distance from an edge of the recording medium P to a position at which the secondary transferring roller 5A and the intermediate transfer member 70 start to contact each other outside the edge of the recording medium P in the main-scanning direction.

By setting the image forming area so as to fulfill the above relationships, it becomes possible to fulfill the relationship shown as follow.

$$0<A<B$$

where,

A (mm): length of a portion of the toner image borne by the intermediate transfer member 70, which is extended from an edge of the recording medium P, when the toner image borne by the intermediate transfer member 70 is transferred onto the recording medium P in a state that the toner image is extended from the edge of the recording medium P, B (mm): length of a distance from an edge of the recording medium P to a position at which the secondary transferring roller 5A and the intermediate transfer member 70 start to contact each other outside the edge of the recording medium P, and wherein directions that regulate A and B are the same as each other, and in the present embodiment, equivalent to either the main-scanning direction or the sub-scanning direction. According to the above, the following features and effects can be achieved.

In the case of employing the secondary transferring roller of the contacting method for the secondary transferring operation, when the secondary transferring roller press-contacts the intermediate transfer member while putting the recording medium P between them, the recording medium P is cohered to the intermediate transfer member due to an elastic deformation of the elastic layer of the secondary transferring roller, while creating a space around the recording medium P at this time. If the toner image is formed within this space area, the secondary transferring roller is hardly contaminated, since the secondary transferring roller does not directly press-contact the toner image (compared to the contacting state, an amount of toner flying in the space and adhering to the secondary transferring roller is overwhelmingly small). Further, even if the toner adheres onto the secondary transferring roller, since its amount is very small and no pressure is applied to the adhered toner, it becomes possible to easily clean the toner having a little adhesive force. Accordingly, it becomes possible to prevent the recording medium P from contaminating its reverse surface due to the toner contamination of the secondary transferring roller. In addition, it becomes possible for the cleaning device, if provided, to easily clean the secondary transferring roller, due to a little amount of residual toner to be cleaned, resulting in a prevention of the toner scattering contamination in the apparatus.

The bias cleaning operation can be preferably employed as a cleaning method. An example of the bias cleaning operation is set forth in Tokkai 2004-309696 (Japanese Non-Examined Patent Publication). According to this method, to clean the residual toner remained on the secondary transferring roller, the voltage having a polarity same as that of the residual toner is applied to the secondary transferring roller so as to transfer the residual toner onto the image bearing member (in the present embodiment, the intermediate transfer member), and then, the residual toner are removed by the cleaning device for the image bearing member (in the present embodiment, the intermediate transfer member).

Further, in the present embodiment, by setting the image forming area, it is possible to achieve the abovementioned effect without complicating the configuration.

As mentioned in the foregoing, it is possible to always keep the secondary transferring roller 5A in a clean state, and therefore, it becomes possible to achieve an image forming operation in which a good image quality is continuously maintained.

Next, the method for finding B1 and B2 will be detailed in the following.

Initially, B1 is found according to the equation shown as follow.

$$B1=(r^2-(r-d)^2)^{1/2}$$

where, d: thickness of the recording medium P as shown in FIG. 6, r: radius of the secondary transferring roller.

Although FIG. 6 is an enlarged cross sectional view of FIG. 5(*b*) indicating a state at the time of completing the transferring operation, B1 is found according to the above equation as well even in regard to FIG. 5(*a*) indicating a state at the time of commencing the transferring operation.

Accordingly, A1 is established so as to fulfill the relationship shown as follow.

$$0<A1<(r^2-(r-d)^2)^{1/2}$$

Incidentally, the above relationship is established when assuming that the secondary transferring roller is a rigid body. However, even in the case that the elastic layer of the secondary transferring roller elastically deforms as described in the present embodiment, by setting A1 so as to fulfill the relationship indicated in the above, the effect of preventing the contamination can be attained. Further, when the secondary transferring roller has the elastic layer, although the value of B1 depends on the thickness "d" of the recording medium, a hardness of the elastic layer of the secondary transferring roller, etc., the value of B1 can be found in advance by conducting an experiment and a simulation.

Further, although the value of B2 depends on the thickness "d" of the recording medium, a hardness of the elastic layer of the secondary transferring roller 5A, etc., the value of B2 can be also found in advance by conducting an experiment and a simulation.

In regard to the thickness "d" of the recording medium, it is preferable that the values of B1 and B2 are determined in conformity with the thickness of the thinnest recording medium among the recording mediums to be possibly used in the image forming apparatus concerned. Further, it is also preferable that the image forming apparatus is provided with a device for detecting the thickness of the recording medium, or is so constituted that the thickness of the recording medium is inputted and set from the operation inputting section 104, so as to display a warning message on the displaying section 17 or ban the image forming operation, when the thickness of the recording medium is further thinner than that of the thinnest recording medium among the recording mediums to be possibly used in the image forming apparatus concerned.

Incidentally, in the abovementioned embodiment, it is preferable that the hardness of the elastic layer of the secondary transferring roller 5A is in a range of 30.degree.-70.degree. in Asker C hardness. By setting the hardness at a value equal to or greater than 30.degree. of Asker C hardness, it becomes possible to increase the values of B1 and B2, resulting in an improvement of the contamination preventing effect for the secondary transferring roller 5A. While, by setting the hardness at a value equal to or smaller than 70.degree. of Asker C hardness, it becomes possible to stably secure the transferring nip portion, and to improve the micro contacting property for the surface of the recording medium P, resulting in an improvement of the transferring stability.

Further, in the embodiment mentioned in the above, when the portion of the image forming area, which is extended from an end of the recording medium in the downstream side of the conveyance direction of the recording medium (namely, the portion of A1) passes through the transferring position (for instance, the transferring nip portion), it is preferable that the value of transferring current to be applied to the secondary transferring roller 5A is set at a value smaller than that to be applied to the secondary transferring roller 5A when the central portion of the recording medium in the conveyance direction passes through the transferring position (for instance, the transferring nip portion). By applying the abovementioned operation, it becomes possible to decrease the value of the transferring current when the toner residing on the portion, extended from an end of the recording medium in the downstream side of the conveyance direction of the recording medium, is secondary transferred, and to prevent the toner from moving to the transferring member more effectively, resulting in an improvement of the effect for preventing the contamination. Incidentally, hereinafter, the term of "when the portion of A1, or the central portion of the recording medium in the conveyance direction passes through the transferring position (for instance, the transferring nip portion)" is defined as the time period while the portion of A1, or the central portion of the recording medium in the conveyance direction resides at the transferring position (for instance, the transferring nip portion).

Figure 7:
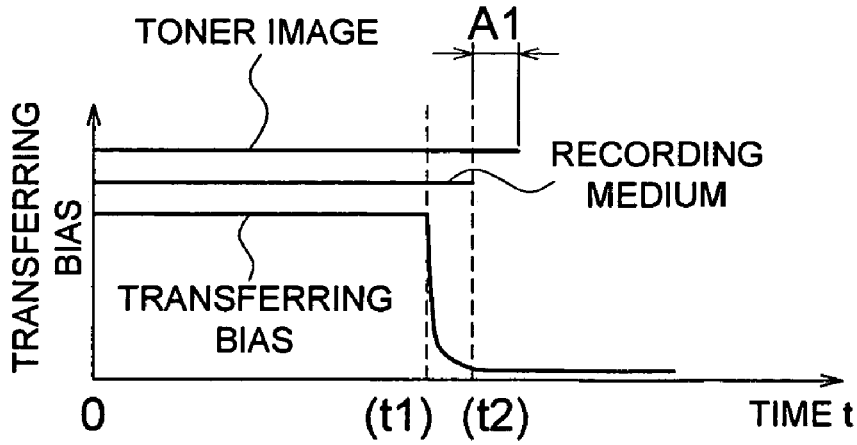
FIG. 7 shows a waveform and a time chart of a transferring bias (a current value) for a secondary transferring operation.

FIG. 7 shows a waveform and a time chart of the transferring bias (the current value) for the secondary transferring operation. In FIG. 7, the horizontal axis indicates a progress of time "t" from the time when the central portion of the recording medium in the conveyance direction arrives at an entrance position of the transferring nip portion. The straight lines located at upper side of the drawing indicate the recording medium and the toner image residing on the intermediate transfer member, and also indicate the transient status in which each portion of the recording medium and the toner image is arriving at the entrance position of the transferring nip portion according to the progress of time "t". For instance, at time "t"=t2, the status in which the trailing edge of the recording medium in the conveyance direction is positioned at the entrance position of the transferring nip portion, namely, the status in which the leading edge of the toner image residing on the extended potion at the trailing edge side is positioned at the entrance position of the transferring nip portion, is indicated. The vertical axis indicates the transferring bias (the current value). As the waveform shown in FIG. 7, it is preferable that, considering the response time (normally, in a range of several tens-100 msec) of the high voltage power source serving as a transfer bias applying device, the transferring bias is switched at time t1 before time t2, and, when the toner image extended from the trailing edge of the recording medium (namely, the portion of A1) passes through the transferring nip portion, the transferring bias is reduced to substantially zero.

Incidentally, in the embodiment mentioned in the above, when outputting the color image in the marginless print mode, by substituting unicolor image data of yellow, magenta and cyan for the black color image data corresponding to at least the extended portion, namely, by substituting unicolor toner of yellow, magenta and cyan for black color toner without employing the black color toner at the time of image-forming operation, when the toner image borne by the intermediate transfer member is transferred onto the recording medium in the transferring operation, it is possible to make the toner image residing on at least the extended portion include substantially no black color toner. This makes it possible to make the contamination of the reverse surface of the recording medium, caused by the contamination of the transferring member, unnoticeable. Incidentally, the term of "include substantially no black color toner" means that the toner image includes no black color toner developed as the image. Accordingly, the case in which black color toner floating in the air, caused by scattering actions, etc., are mingled into the toner image is included in the scope of the term of "include substantially no black color toner".

Figure 8:
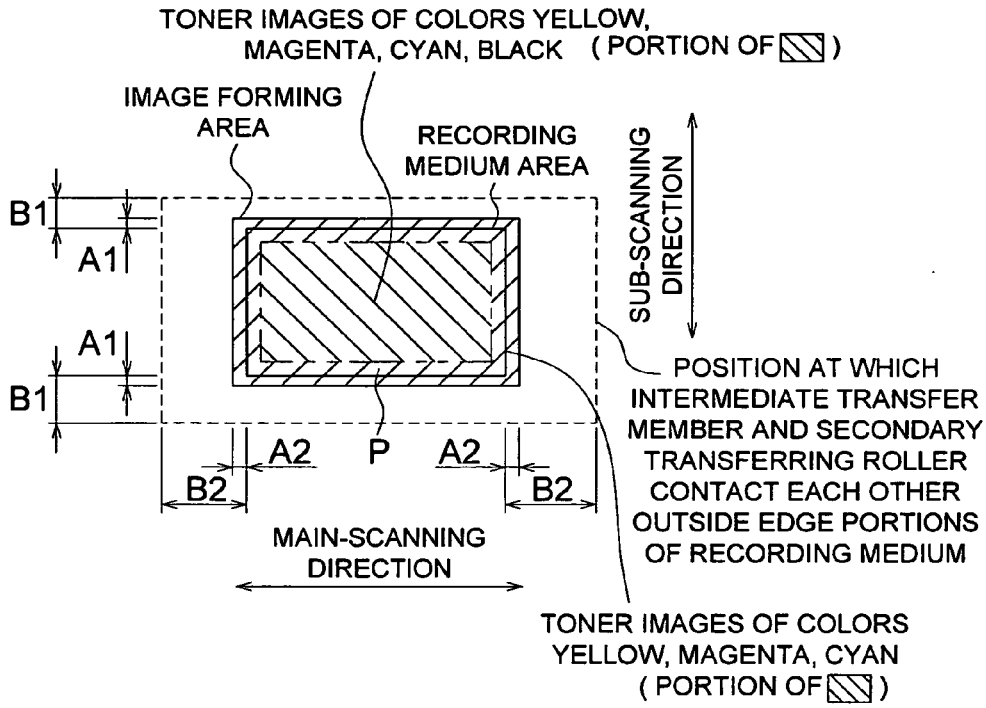
FIG. 8(*a*) and FIG. 8(*b*) show schematic diagrams indicating relationship between an image forming area and a recording medium area at the time of a secondary transferring operation.
Figure 8:
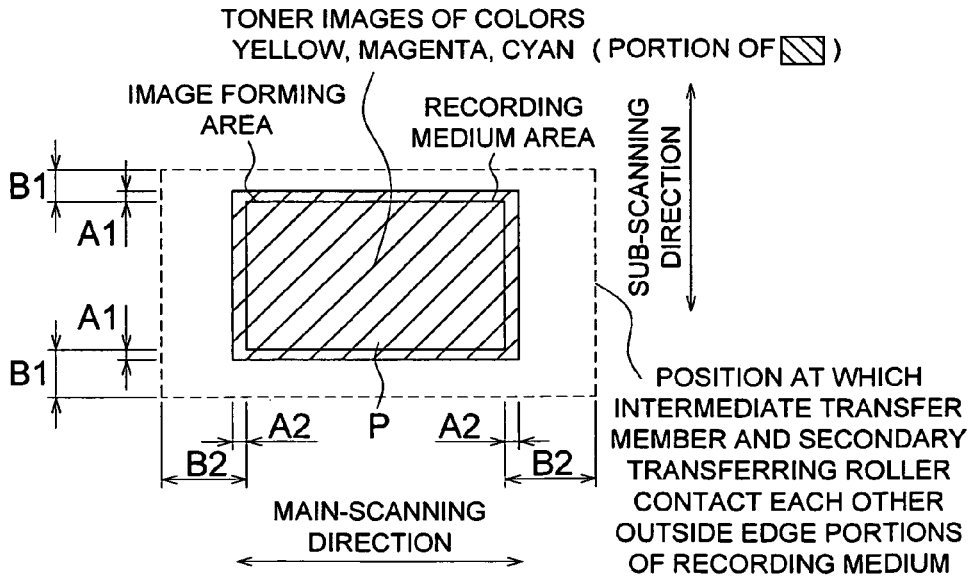

FIG. 8(*a*) and FIG. 8(*b*) show schematic diagrams indicating relationship between the image forming area and the recording medium area at the time of the secondary transferring operation, when each of unicolor images of yellow, magenta, cyan and black is formed all over the image forming area. In FIG. 8(*a*) and FIG. 8(*b*), the solid lines, the alternate long and short dash lines, the broken lines and the alternate long and two short dashes lines indicate four edges of the image forming area, four edges of the recording medium P (position of the recording medium P), a position (four edges) at which the secondary transferring roller 5A and the intermediate transfer member 70 contact each other outside the four edges of the recording medium P and the image forming area of each unicolor image of yellow, magenta, cyan and black, respectively.

As shown in FIG. 8(*a*), it is applicable that the black toner image is formed within an area equivalent to or narrower than that of the recording medium P (namely, same as or inside the area of the recording medium P. Further, in the case of the full color image forming operation, the toner images of yellow, magenta and cyan are also formed within the area), and, with respect to outside of the abovementioned area, the black toner image is substituted by the unicolor toner images of yellow, magenta and cyan without employing the black toner so as to include substantially no black color toner.

Incidentally, in the embodiment described in the foregoing, although the secondary transferring roller 5A serves as a transferring member embodied in the present invention, it is also applicable that a blade or a belt is employed as a transferring member, instead of the roller.

Further, in the embodiment described in the foregoing, the image is formed in the marginless print mode, in such a manner that the image covers all over the peripheral edge portion of the recording medium P, namely, the four edge portions around the recording medium P without including any margin space. However, it is applicable that the marginless print mode is applied to, for instance, a part of the peripheral edge portion of the recording medium P. Concretely speaking, for instance, the marginless print mode can be applied to only one side of the recording medium P in the main-scanning direction (width direction), only both sides of the recording medium P in the main-scanning direction, only one side of the recording medium P in the sub-scanning direction (conveyance direction) or only both sides of the recording medium P in the sub-scanning direction.

Still further, when the marginless print mode is applied to a part of the four edge portions of the recording medium P, it is preferable that the marginless print mode is applied to three edge portions of the recording medium P, excluding the leading edge portion of the recording medium P in the conveyance direction. This is because, when the marginless print mode is applied to the leading edge portion of the recording medium P, there has been liable to occur such a trouble that the recording medium P is wound by the fixing roller. Accordingly, to avoid such the trouble, the above measure is preferable.

Still further, in the embodiment described in the foregoing, the color image forming apparatus employing the intermediate transfer method is exemplified for explaining the image forming apparatus embodied in the present invention. However, the scope of the image forming apparatus embodied in the present invention is not limited to the above. It is needless to say that a color image forming apparatus employing the tandem image forming method instead of the intermediate transfer member, or further, a monochrome image forming apparatus is also applicable in the present invention.

Still further, in the color image forming apparatus employing the tandem image forming method instead of the intermediate transfer member or the monochrome image forming apparatus, the photoreceptor member serving as an image bearing member and the transferring member are disposed at positions opposed to each other, and the toner image is transferred onto the recording medium P from the photoreceptor member while the recording medium P is passing through the nip potion formed between the photoreceptor member and the transferring member.

Still further, in the embodiment described in the foregoing, although the recording medium P is typically a paper sheet, such as a normal paper or the like, the scope of the recording medium P is not limited to the above. It is needless to say that a PET base sheet for OHP use, etc. are also included in the scope of the recording medium P.

Yet further, in the embodiment described in the foregoing, the image forming apparatus employing the electro-photographic method is exemplified as the image forming apparatus embodied in the present invention. However, the scope of the image forming apparatus embodied in the present invention is not limited to the above. For instance, the present invention can be applied to such an image forming apparatus that forms a toner image on the image bearing member by emitting toner from a nozzle of a recording head, and then, transfers the toner image onto the recording medium P.

Referring to the examples, the present invention will be detailed in the following. However, the scope of the present invention is not limited to the examples detailed in the following.

Example 1

Employing the color image forming apparatus shown in FIG. 1, solid unicolor images of four colors Y (Yellow), M (Magenta), C (Cyan), K (Black) were formed. Unless otherwise specified, each of image forming conditions is common to the four colors Y, M, C, K.

By setting as A1=A2=2 (mm) for each of image forming areas of colors Y, M, C, K on the photoreceptor drum, each of the solid unicolor images was formed all over the image forming area. Accordingly, the length of the extended toner image becomes 2 (mm) in both main-scanning and sub-scanning directions.

A recording paper having a thickness of 0.2 (mm) was employed as the recording medium P.

By employing five kinds of secondary transferring rollers having the same radius of 15 (mm) and being different from each other in Asker C hardness of the elastic layer as shown in Table 1, the image forming operation was conducted with respect to each of them. The values of B1 and B2 (each equivalent to B) were in a range of 2.4-3 (mm) for everyone of the five kinds of secondary transferring rollers (2.4 mm<B1, B2<3 mm). In addition, there has been recognized a tendency that the harder the hardness of the roller becomes, the greater the values of B1 and B2 increase.

Further, the secondary transferring current at the time of the secondary transferring operation was set at a predetermined value and kept constant.

The voltage having a polarity same as that of toner was applied to the secondary transferring roller between the recording papers, and the bias cleaning operation was conducted.

The visual inspection was conducted for observing the contamination of the secondary transferring roller after the secondary transferring operation was completed, and then, the degree of the contamination was evaluated as follow.

Excellent: no contamination occurred

Good: practically no problem

Passable: recognizable level

Bad: fully visible contamination band occurred

Example 2

The image forming operation and the evaluation were conducted under the conditions same as those of EXAMPLE 1, except that A=A1=A2=2.4 (mm) was set.

Example 3

The image forming operation and the evaluation were conducted under the conditions same as those of EXAMPLE 1, except that the transferring bias waveform as shown in FIG. 7 was employed, and the transferring bias was lowered for the extended toner image developed in the image forming area A1 extended downstream in the conveyance direction of the recording medium.

Example 4

The image forming operation and the evaluation were conducted under the conditions same as those of EXAMPLE 1, except that the transferring bias waveform as shown in FIG. 7 was employed, and the transferring bias was lowered for the extended toner image developed in the image forming area A1 extended downstream in the conveyance direction of the recording medium.

Example 5

The image forming operation and the evaluation were conducted under the conditions same as those of EXAMPLE 1, except that the developing operation was conducted by substituting toner of colors Y, M, C for the black toner without employing the black toner all over the image forming area as shown in FIG. 8(*b*).

Example 6

The image forming operation and the evaluation were conducted under the conditions same as those of EXAMPLE 2, except that the developing operation was conducted by substituting toner of colors Y, M, C for the black toner without employing the black toner all over the image forming area as shown in FIG. 8(*b*).

Comparison Example 1

The image forming operation and the evaluation were conducted under the conditions same as those of EXAMPLE 1, except that A=A1=A2=3 (mm) was set.

The evaluation results of examples 1-6 and comparison example 1 are shown in Table 1.

TABLE 1

| | Length of extended image A | Roller hardness (Asker C hardness) 25° | 30° | 50° | 70° | 75° |
|---|---|---|---|---|---|---|
| Example 1 | 2 mm | Good | Excelent | Excelent | Excelent | Excelent |
| Example 2 | 2.4 mm | Passable | Good | Excelent | Excelent | Excelent |
| Example 3 | 2 mm | Excelent | Excelent | Excelent | Excelent | Excelent |
| Example 4 | 2.4 mm | Good | Excelent | Excelent | Excelent | Excelent |
| Example 5 | 2 mm | Excelent | Excelent | Excelent | Excelent | Excelent |
| Example 6 | 2.4 mm | Excelent | Excelent | Excelent | Excelent | Excelent |
| Comparison example 1 | 3 mm | Bad | Bad | Bad | Bad | Bad |

Compared to comparison example 1, the degrees of contamination in examples 1-6 were low. Accordingly, the effect of preventing the contamination, to be attained in the present invention, was confirmed.

Further, with respect to each of examples 1-6, it was confirmed that the effect for preventing the contamination of the secondary transferring roller could be improved by setting the hardness of the elastic layer at a value equal to or greater than 30°. However, when setting it at 75°, a certain level of instability was recognized in the transferring operation.

Still further, with respect to examples 3 and 4, it was confirmed that the contamination of the secondary transferring roller could be reduced to further lower level, compared to examples 1 and 2, and the effect for preventing the contamination of the secondary transferring roller could be improved, by setting the transferring bias to be applied to the extended toner image developed on the image forming area A1, extended downstream in the conveyance direction of the recording medium P, at a low value. With respect to examples 5 and 6, it was also confirmed that the contamination of the secondary transferring roller could be reduced to further lower level, compared to examples 1 and 2, and the effect for preventing the contamination of the secondary transferring roller could be improved, by excluding the toner of color K (black toner) in the developing operation for all over the image forming area.

While the preferred embodiments of the present invention have been described using specific term, such description is for illustrative purpose only, and it is to be understood that changes and variations may be made without departing from the spirit and scope of the appended claims.

What is claimed is:

1. An image forming apparatus, comprising:

an image bearing member to bear a toner image;

a recording medium that accepts the toner image to be transferred from the image bearing member; and a transferring member that press-contacts the image bearing member while pressing the recording medium against the toner image residing on the image bearing member so as to transfer the toner image onto the recording medium;

wherein, when the transferring member transfers the toner image residing on the image bearing member onto the recording medium in such a state that the toner image is extended from an edge of the recording medium, a positional relationship between the transferring member, the recording medium and the image bearing member is established so as to fulfill a specific relationship of:

$$0<A<B$$

where

A is defined as a length of an extended portion of the toner image residing on the image bearing member, the extended portion being relatively extended from the edge of the recording medium; and B is defined as a length of a distance from the edge of the recording medium to an edge of a contacting area at which the transferring member and the image bearing member press-connect each other outside the edge of the recording medium; and wherein a direction of the length A is substantially the same as that of the length B.

2. The image forming apparatus of claim 1, further comprising:

a photoreceptor member to form a toner image thereon wherein the photoreceptor member also serves as the image bearing member, and the positional relationship between the transferring member, the recording medium and the photoreceptor member is established so as to fulfill the specific relationship of:

$$0<A<B.$$

3. The image forming apparatus of claim 1, further comprising:

a photoreceptor member to form a toner image thereon;

wherein the image bearing member is an intermediate transfer member, onto which the toner image formed on the photoreceptor member is transferred, and, from which the toner image, transferred from the photoreceptor member, is further transferred onto the recording medium; and wherein the positional relationship between the transferring member, the recording medium and the intermediate transfer member is established so as to fulfill the specific relationship of $$0<A<B.$$

4. The image forming apparatus of claim 1, further comprising:

a conveying section to convey the recording medium to a transferring position at which the image bearing member bearing the toner image and the transferring member oppose to each other;

wherein the transferring member is a transferring roller, and when the transferring roller transfers the toner image residing on the image bearing member onto the recording medium in such a state that the toner image is extended from an edge of the recording medium located downstream in a conveyance direction of the recording medium, the length B fulfills a relation shown as follows, $$B=(r^2-(r-d)^2)^{1/2}$$

where d is defined as a thickness of the recording medium;

r is defined as a radius of the transferring roller.

5. The image forming apparatus of claim 1, wherein the transferring member is provided with an elastic layer, a hardness of which is in a range of 30°-70° in Asker C hardness.

6. The image forming apparatus of claim 1, further comprising:

a conveying section to convey the recording medium to a transferring position at which the image bearing member bearing the toner image and the transferring member oppose to each other; and a transfer bias applying section to apply a transferring bias to the recording medium;

wherein, when the transferring roller transfers the toner image residing on the image bearing member onto the recording medium in such a state that the toner image is extended from an edge of the recording medium located downstream in a conveyance direction of the recording medium, a value of the transferring bias, to be applied at a time when the extended portion of the toner image passes through the transferring position, is smaller than that of the transferring bias, to be applied at a time when a center portion of the recording medium in a conveyance direction of the recording medium passes through the transferring position.

7. The image forming apparatus of claim 1, wherein the image forming apparatus is a color image forming apparatus, and, when the transferring member transfers the toner image residing on the image bearing member onto the recording medium in such a state that the toner image is extended from the edge of the recording medium, at least the extended portion of the toner image includes substantially no black toner.

* * * * *